US006186232B1

(12) United States Patent
Isaacs et al.

(10) Patent No.: US 6,186,232 B1
(45) Date of Patent: Feb. 13, 2001

(54) ENHANCED OIL RECOVERY BY ALTERING WETTABILITY

(75) Inventors: Eddy Isaacs; Tawfik Nasr; Alex Babchin, all of Edmonton (CA)

(73) Assignee: Alberta Oil Sands Technology and Research Authority, Calgary ( * ) Notice: Under 35 U.S.C. 154(b), the term of this patent shall be extended for 0 days.

(21) Appl. No.: 09/176,123

(22) Filed: Oct. 21, 1998

(51) Int. Cl.[7] ..... E21B 43/24
(52) U.S. Cl. ..... 166/272.3; 166/272.7
(58) Field of Search ..... 166/272.3, 272.7, 166/269, 303

(56) References Cited

U.S. PATENT DOCUMENTS

| | | | | |
|---|---|---|---|---|
| 3,102,589 | | 9/1963 | Graham et al. | 166/15 |
| 3,338,306 | | 8/1967 | Cook | 166/40 |
| 3,498,378 | | 3/1970 | Stone et al. | 166/263 |
| 3,580,338 | | 5/1971 | Sparlin | 166/276 |
| 3,910,350 | | 10/1975 | Mastroianni | 166/274 |
| 3,967,682 | | 7/1976 | Stein et al. | 166/278 |
| 4,248,302 | | 2/1981 | Churchman | 166/272 |
| 4,522,732 | * | 6/1985 | Purcell et al. | 166/270 |
| 4,553,595 | | 11/1985 | Huang et al. | 166/278 |
| 4,836,285 | * | 6/1989 | Navratil et al. | 166/295 |
| 4,953,619 | | 9/1990 | Dullien et al. | 166/265 |
| 5,042,580 | | 8/1991 | Cullick et al. | 166/252 |
| 5,215,146 | | 6/1993 | Sanchez | 166/263 |
| 5,289,876 | | 3/1994 | Graham | 166/276 |
| 5,411,086 | * | 5/1995 | Burcham et al. | 166/272.3 |
| 5,788,781 | * | 8/1998 | Van Slyke | 134/40 |

* cited by examiner

*Primary Examiner*—William P. Neuder
(74) *Attorney, Agent, or Firm*—Kurt D. Van Tassel; Deborah G. VandenHoff; Van Tassel & Associates

(57) ABSTRACT

A process is disclosed for enhancing oil recovery in oil-containing reservoirs formed of water-wet sand. The process involves placing oil-wet sand in the near-bore region of a production well. The process can be used to provide an improvement to both a conventional pressure driven fluid drive process and a conventional steam-assisted gravity drainage process. In the fluid drive process, the drive fluid is injected intermittently.

9 Claims, 6 Drawing Sheets

2
1
6
4
9
5
3
8
1A
7
10
2A 9
1
2
10

ENHANCED OIL RECOVERY BY ALTERING WETTABILITY

FIELD OF THE INVENTION

The present invention relates to improving a fluid drive or steam assisted gravity drainage ("SAGD") process for recovering oil from a subterranean, oil-containing, water-wet sand reservoir. More particularly the invention relates to altering the nature of the sand in the near bore region of the production well to an oil-wet condition, to thereby obtain enhanced oil recovery.

BACKGROUND OF THE INVENTION

In a SAGD process, steam is injected into a reservoir through a horizontal injection well to develop a vertically enlarging steam chamber. Heated oil and water are produced from the chamber through a horizontal production well which extends in closely spaced and parallel relation to the injection well. The wells are positioned with the injection well directly over the production well or they may be side by side.

SAGD was originally field tested with respect to recovering bitumen from the Athabasca oil sands in the Fort McMurray region of Alberta. This test was conducted at the Underground Test Facility ("UTF") of the present assignee. The process, as practiced, involved:

- completing a pair of horizontal wells in vertically spaced apart, parallel, co-extensive relationship near the bottom of the reservoir;
- starting up by circulating steam through both wells at the same time to create hot elements which functioned to slowly heat the span of formation between the wells by heat conductance, until the viscous bitumen in the span was heated and mobilized and could be displaced by steam injection to the production well, thereby establishing fluid communication from the developing chamber down to the production well; and
- then injecting steam through the upper well and producing heated bitumen and condensate water through the lower well. The steam rose in the developing bitumen-depleted steam chamber, heated cold bitumen at the peripheral surface of the chamber and condensed, with the result that heated bitumen and condensate water drained, moved through the interwell span and were produced through the production well.

This process, as practised at the UTF, is described in greater detail in Canadian patent 2,096,999.

Successful recovery of bitumen during the SAGD process depends upon the efficient drainage of the mobilized bitumen from the produced zone to the production well.

One object of the present invention is to achieve improved drainage, as evidenced by increased oil recovery.

SUMMARY OF THE INVENTION

The present invention had its beginnings in a research program investigating the effect of wetting characteristics of oil reservoir sand on oil recovery. Athabasca oil sand from the Fort McMurray region is water-wet in its natural state. The following experiments were performed using water-wet sand saturated with oil to mimic the naturally occurring oil sand.

Three pressure driven flood experimental runs from the program were of interest. In each of these runs, oil-saturated, water-wet sand was packed into a horizontal, cylindrical column and several pore volumes of brine were injected under pressure through one end of the column (the "injection end"). Oil and brine were produced at the opposite end of the column (the "production end"). The oil and brine were separated and the amount of oil quantified. In the first run, the column was packed entirely with oil-saturated water-wet sand and the brine was pumped continuously. In the second run, a thin, oil-wet membrane was added to the production end of a column that had been packed with water-wet sand and oil-saturated as in run 1. Again, the injection of the brine was continuous. There was no appreciable difference in oil recovery between runs 1 and 2. In the third run, the column was packed as in run 2 and a thin, oil-wet membrane added to the production end. However, in this run the injection of brine was intermittent. There were significant pauses or shut-downs (having a length anywhere from several hours to several days) in pumping of the brine. The oil recovery from the third run was significantly greater than had been the case for runs 1 and 2.

From these experiments and additional work, it was concluded and hypothesized:

- that provision of an oil-wet oil membrane at the production end of a column of oil-saturated, water-wet sand was beneficial to recovery;
- that the pumping shut-downs or cyclic injection provided quiescent periods during which we postulated that oil was drawn by capillary effects or imbibed into the oil-wet membrane with corresponding displacement of resident water; and
- that this combination of features enabled oil to flow more easily through the production end, leading to improved oil production rate and recovery.

From this beginning it was further postulated that adding oil-wet sand to surround the production well and then practising the SAGD process might provide an opportunity for imbibing to materialize (the SAGD process typically does not involve large pressure differentials and might therefore provide a quiescent condition similar to that occurring during the cyclic injection used in the third pressure driven flood run).

At this point, a bench scale cell was used in a laboratory circuit, to simulate an SAGD process. More specifically, an upper horizontal steam injection well was mounted to extend into the cell, together with a lower horizontal oil/water production well. Two runs of interest were conducted. In the first run, the cell was packed entirely with oil-saturated, water-wet sand. Steam was injected through the upper well and oil and condensed water were produced through the production well. In the second run, oil-wet sand was provided to form a lower layer in the cell and the production well was located in this layer; oil-saturated, water-wet oil sand formed the upper layer and contained the injection well. As in the first run, steam was injected through the upper well and oil and condensed water were produced through the production well. In the first run, about 27% of the oil in place was recovered after 200 minutes of steam injection. In the second run, about 40% of the oil was recovered over the same period. The oil production rate in the second run was also higher than that for the first run.

In summary then, the invention has two broad aspects.

In one aspect, the invention provides an improvement to a conventional pressure driven fluid flood or drive process conducted in an oil-containing reservoir formed of water-wet sand using injection and production wells. The improvement comprises: providing a body of oil-wet sand in the near-bore region of the production well and injecting the drive fluid intermittently.

In another aspect, the invention provides an improvement to a conventional steam-assisted gravity drainage process conducted in an oil-containing reservoir formed of water-wet sand using injection and production wells. The improvement comprises: providing a body of oil-wet sand in the near-bore region of the production well and then applying the SAGD process.

The body of oil-wet sand may be emplaced in the near-bore region by any conventional method such as: completing the well with a gravel pack-type liner carrying the sand; or circulating the sand down the well to position it in the annular space between the wellbore surface and the production string.

The "near well-bore region" is intended to mean any portion of that region extending radially outward from the center line of the production string to a depth of about 3 feet into the reservoir and extending longitudinally along that portion of the production well in the reservoir.

By way of explanation, we believe that placement of oil-wet sand in the near well-bore region serves to maintain a continuous oil flow. This, when combined with a low pressure differential regime, causes oil to imbibe into the region and has the effect of easing oil flow into the well, which leads to enhanced recovery.

DESCRIPTION OF THE PREFERRED EMBODIMENT

Figure 1:
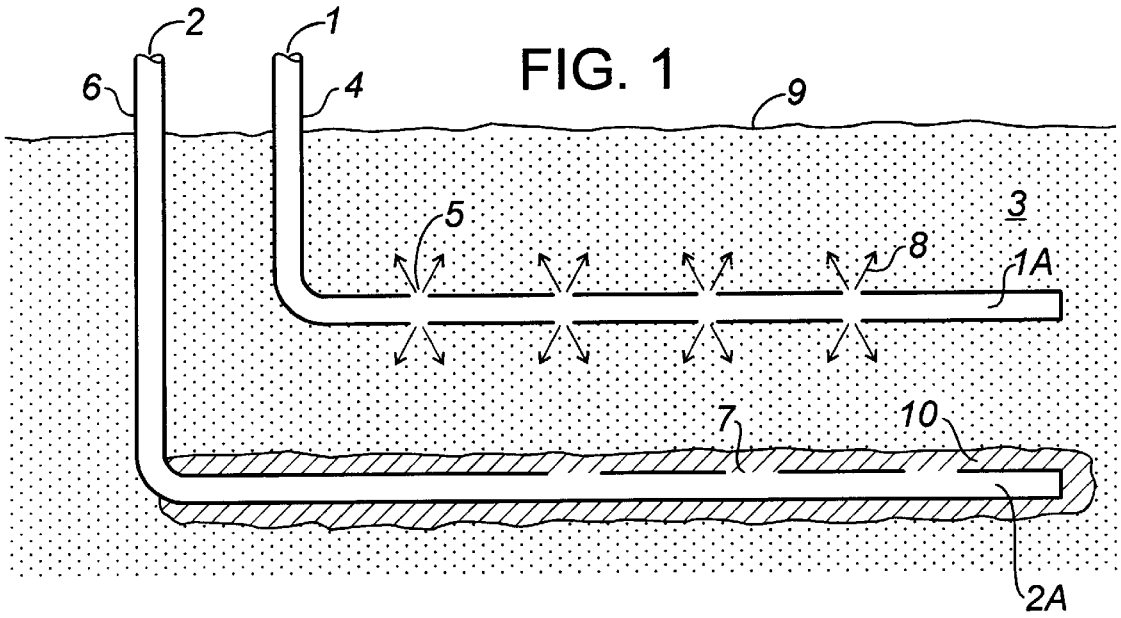
FIG. 1 is a simplified schematic vertical cross-section of a well configuration for practicing the invention in the field.
Figure 2:
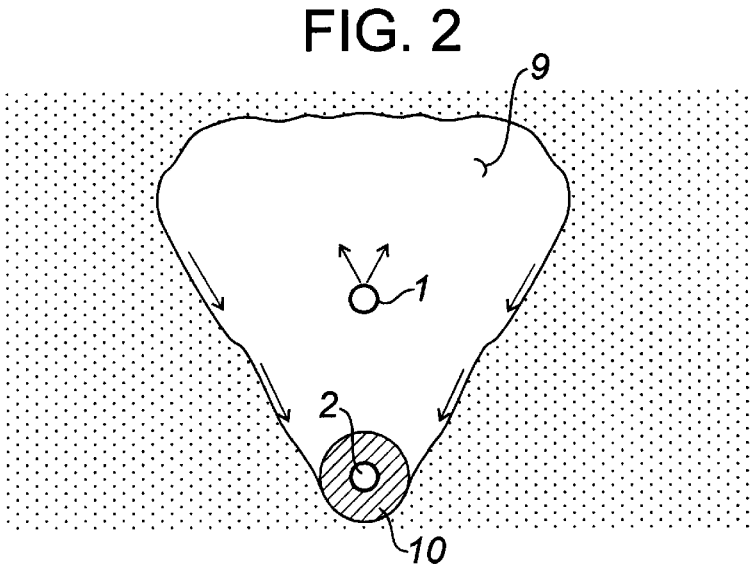
FIG. 2 is a schematic end view in section of the well configuration of FIG. 1.

The invention is concerned with modifying a conventional SAGD system. Having reference to FIGS. 1 and 2, an SAGD system comprises steam injection and oil/water production wells 1,2. The wells have horizontal sections 1*a*, 2*a* completed in an oil sand reservoir 3 so that the injection well section 1*a* overlies the production well section 2*a*. The reservoir 3 is formed of water-wet sand or other solids. The injection well 1 is equipped with a tubular steam injection string 4 having a slotted liner 5 positioned in the horizontal section 1*a*. The production well 2 is equipped with a tubular production string 6 having a slotted liner 7 positioned in the horizontal section 2*a*. Fluid communication is established between the wells 1,2, for example by circulating steam through each of the wells to heat the span 8 by conduction, so that the oil in the span is mobilized and drains into the production well. Steam injection is then commenced at the injection well. The steam rises and heats oil which drains, along with condensed water, down to the production well and is produced. An expanding steam chest 9 is gradually developed as injection proceeds.

In accordance with the invention, a layer 10 of oil-wet sand is emplaced along at least part of the horizontal section 2*a* of the production well. This may be accomplished by circulating the sand into place or packing it at ground surface into a gravel-pack type liner before running it into the well as part of the production string. Alternatively, one could treat the sand in-place with a suitable solution to render the sand oil-wet. For example, one could apply an acid wash to the formation in the near well-bore region.

The experimental work underlying the invention is now described.

Water-wet sand was used in the following experiments unless otherwise stated. The water-wet sand was packed in either a column or a test cell and saturated with oil. About eighty-five percent (85%) of the pore volume of the packed sand was oil saturated.

EXAMPLE I

This example describes the treatment used to convert water-wet sand to an oil-wet condition. This treatment involved coating the sand with asphaltene to render it oil-wet.

It further describes a test used to assess the wetted nature of the treated sand.

More particularly, water-wet sand was first dried by heating it at 500° C. for several hours. Asphaltenes were extracted from Athabasca bitumen and diluted in toluene to give a 10 weight % asphaltene/toluene solution. The asphaltene/toluene solution was added to the dry sand in an amount sufficient to totally coat the sand particles with asphaltene without having the sand particles sticking together. Typically the amount of the asphaltenes added per volume of sand was about 0.1%. The asphaltene/toluene/sand mixture was put in a rotary evaporator to evaporate the toluene. As the toluene evaporated, the asphaltene stuck to the sand particles in a thin film. The treated sand was then heated in an oven at 150° C. for several hours.

Wetting tests were conducted on the treated sand to determine whether it was oil-wet. More particularly, treated sand saturated with oil was placed in a glass tube and water was poured into the tube. Observation that no oil was displaced from the sand by the water was accepted as an indication that the grains were oil-wet. In the case of non-treated water-wet sand, the oil was easily displaced by water and flowed to the top by gravity. This was accepted as an indication that the sand grains were water-wet.

The effect of steam on the oil-wet properties on the treated sand was also tested. It was observed that when the treated sand was subjected to steam at 115° C. for 20 hours, it maintained its oil-wet properties in accordance with the test described above.

EXAMPLE II

This example describes 3 runs that showed that the provision of an oil-wet membrane at the production end of a column would increase oil recovery when coupled with intermittent flooding with brine.

Figure 3:
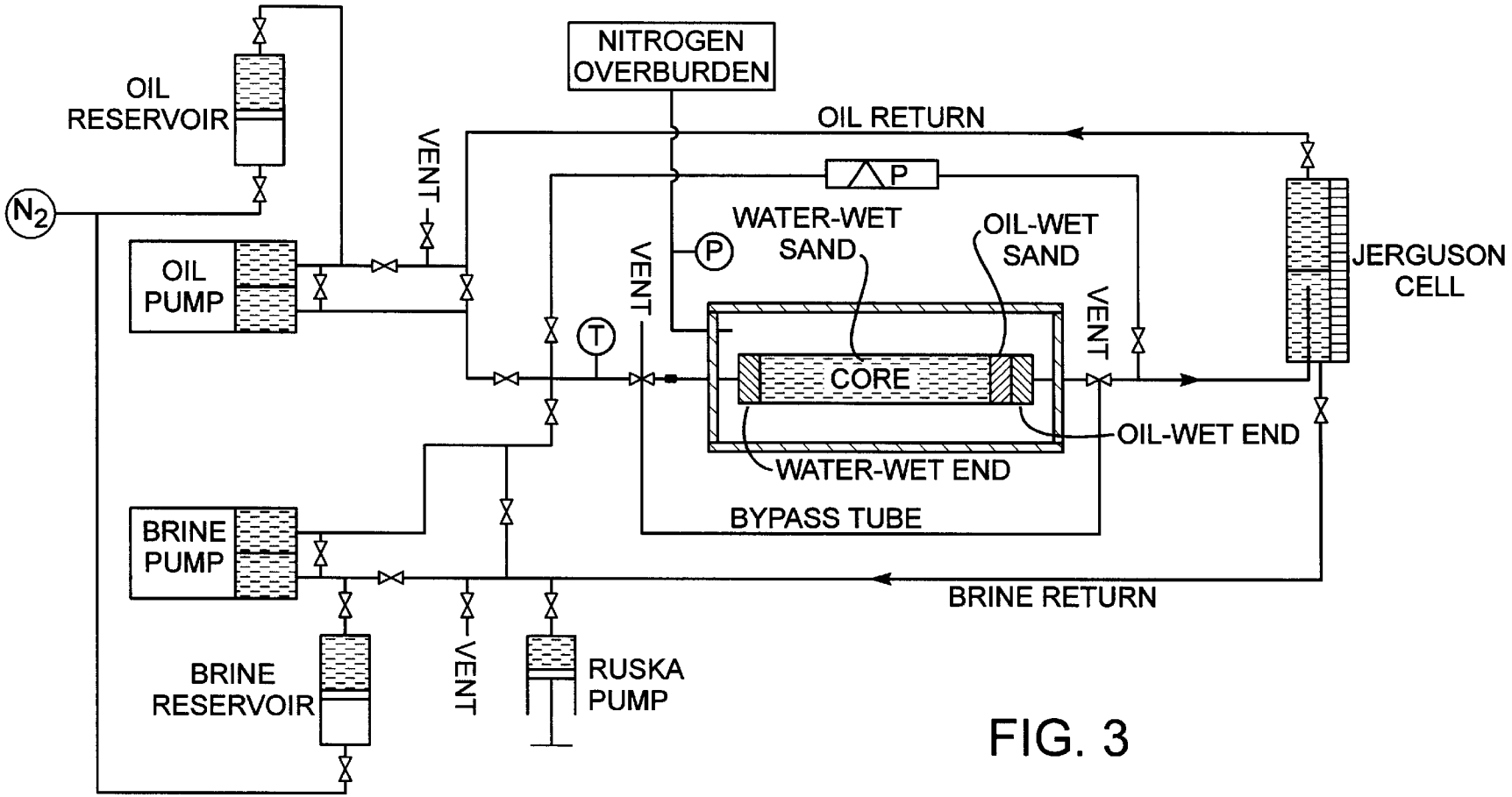
FIG. 3 is a schematic of the laboratory column circuit used to carry out the pressure drive runs.

More particularly, a laboratory circuit shown in FIG. 3 was used. The entire volume of a 30 cm×10 cm diameter column was packed with water-wet sand and then saturated with oil so that about 85% of the pore volume was oil. The column was run in the horizontal position.

In run 1, brine was pumped through one end of the column (the "injection end") at a constant rate of 25 cc/hr until it had been washed with 6 pore volumes of brine. Fractions of eluate were collected from the opposite end of the column (the "production end"). The oil and brine were separated and the amount of oil in each fraction quantified.

In runs 2 and 3, the column was packed with water-wet sand and saturated with oil as in run 1. However, an oil-wet membrane (a 5 mm metallic porous membrane that had been treated with organosaline) was placed at the production end in both runs.

In run 2, the column was washed at a constant rate of 25 cc/hr with three pore volumes of brine, fractions of eluate collected and the oil content in each fraction quantified.

In run 3, the column was washed intermittently with brine. Brine was pumped through the column at a rate of 25 cc/hr. However, after one pore volume of brine had been pumped, the pump was shut off and the column allowed to "rest" for several hours. Pumping of brine was resumed at a rate of 25 cc/hr for a short period of time and then pumping was stopped again. The pumping of brine was resumed after several hours. The pumping was stopped and restarted at least 15 times in total until 3 pore volumes of brine had been added to the column. The stop periods would vary anywhere from several hours to several days. Throughout the stop-start procedure, fractions of eluate were collected and oil content measured.

Figure 6:
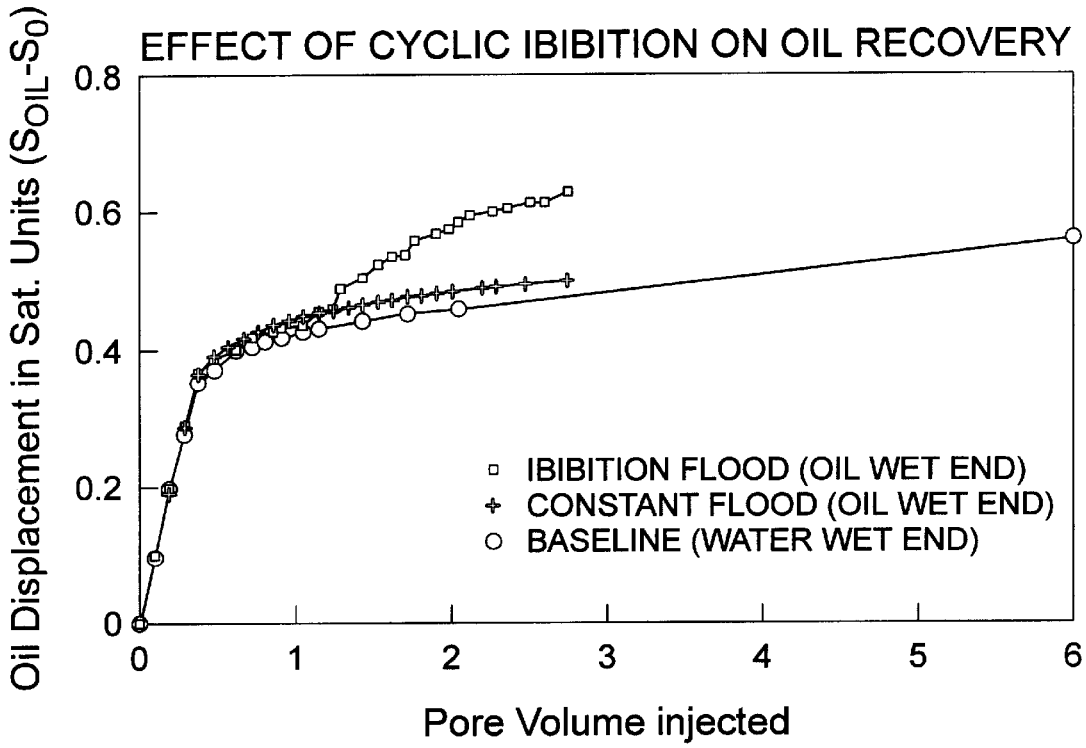
FIG. 6 is a plot of oil displacement versus pore volume injected showing the effect of cyclic imbibition on oil recovery.

FIG. 6 is a plot of oil displacement versus pore volume injected for each of runs 1, 2 and 3. After injection of 2.7 pore volumes of brine, run 1 displaced 47.5% of the oil, run 2 displaced 49.2% of the oil and run 3 displaced 62.5% of the oil. The results indicate that the addition of the oil-wet membrane in run 2 did not markedly affect oil recovery. However, when the oil-wet membrane was coupled with intermittent washes as in run 3, oil recovery increased by about 50% relative to run 1.

EXAMPLE III

This example describes 2 SAGD runs conducted in a test cell. The runs show that provision of oil-wet oil sand in the near-bore region of the production well, when coupled with SAGD, increases recovery when compared to the case where only water-wet oil sand is used.

Figure 4:
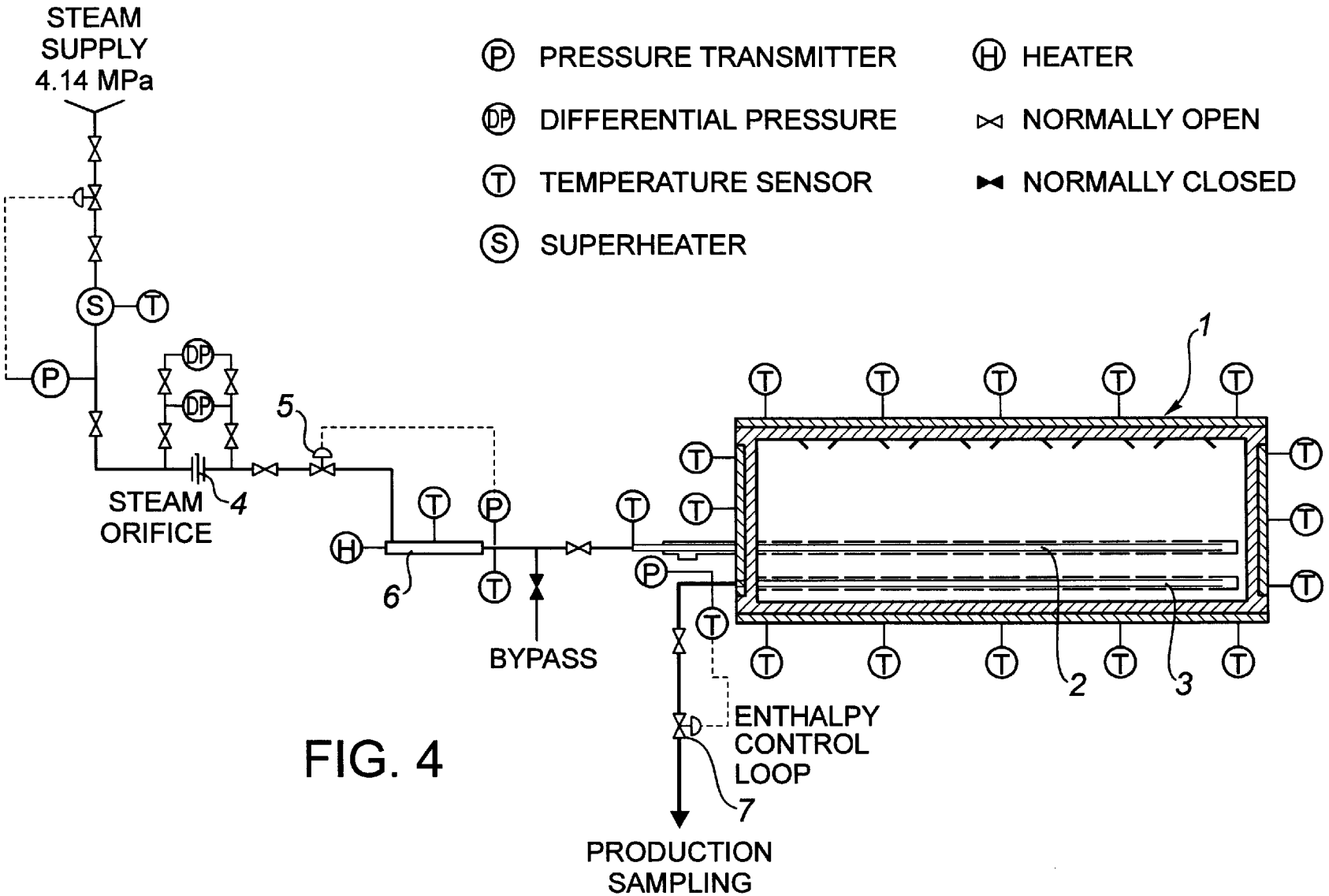
FIG. 4 is a schematic of the laboratory visualization cell circuit used to carry out the SAGD runs.

More particularly, a 0.6 m×0.21 m×0.03 m thickness scaled visualization cell 1 was used. The sides of the cell were transparent. An upper injection well 2 and a lower production well 3 were provided. The wells were horizontal and spaced one above the other in parallel relationship. Both wells were constructed from 0.64 cm diameter stainless steel tube that was slotted with 0.11 cm wide by 5.1 cm long slots. A schematic illustration of the experimental set-up is shown in FIG. 4. Steam flow rate was measured using an orifice meter 4. A control valve 5 was used to deliver steam to the injection well at about 20 kPa (≈3 psig). An in-line ARI resistance heater 6 and a heat trace were used to maintain a maximum of 10° C. superheating at the point of injection. To achieve "enthalpy control" (steam trap) control over the production of fluids, a valve 7 was thermostatically controlled to throttle the production well and ensure that only oil and condensate were produced.

Figure 5:
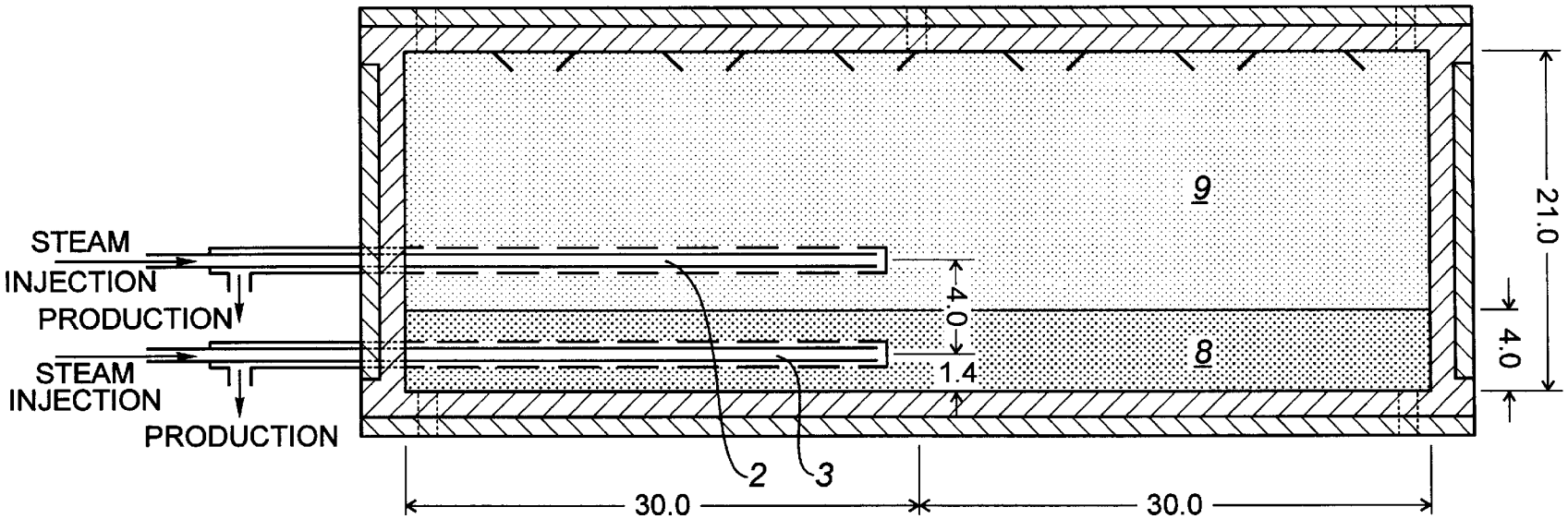
FIG. 5 is an expanded view of the cell of FIG. 4 showing the sand packing for the $2^{nd}$ SAGD run.

In the baseline first run, the cell was entirely filled with oil-saturated, water-wet sand. In the second run, as shown in FIG. 5, the bottom section 8 of the cell was packed with a layer of oil-wet sand treated in accordance with Example I and the upper section 9 was packed with non-treated oil-saturated, water-wet sand. In the second run, the steam injection well 2 was located in the upper water-wet section 9 and the production well 3 was located in the lower oil-wet section 8.

The initialization of gravity drainage was achieved by injecting steam for 30 minutes into both wells at once for about 30 minutes while producing from both wells at the same time. Following the initialization period, steam was injected into the top well only and production fluids were obtained from the bottom well. The experiment lasted for a total of 700 minutes. The production fluids were collected every 15 minutes, the oil and water separated, and the amount of oil recovered measured.

Figure 7:
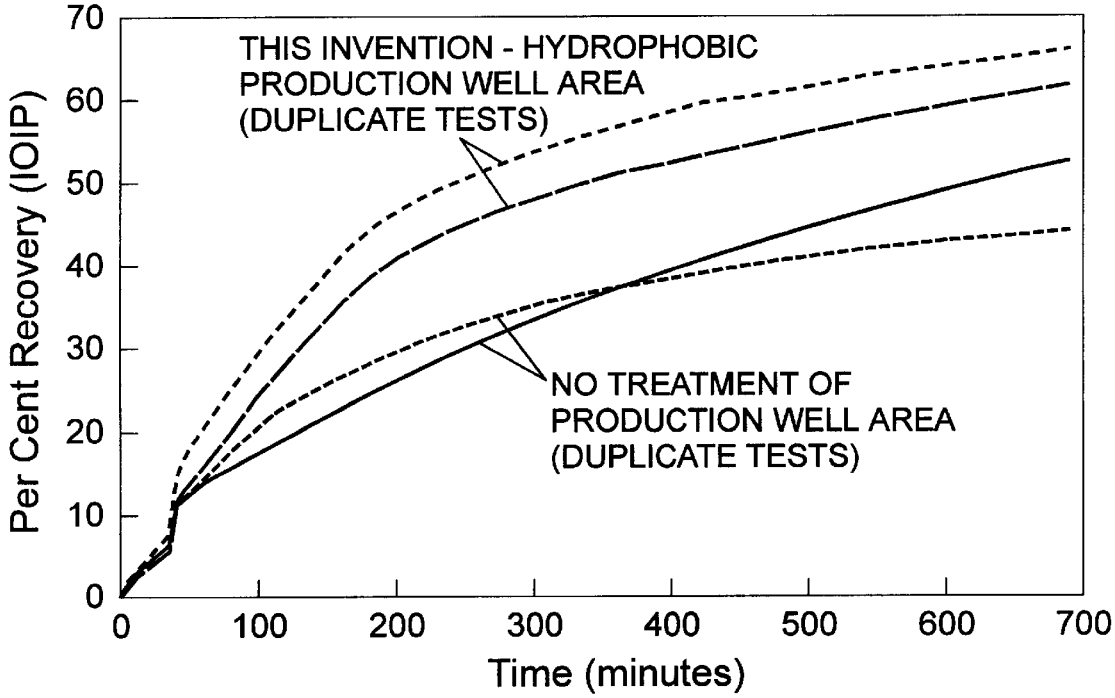
FIG. 7 is a plot of the percent oil recovery versus time.
Figure 8:
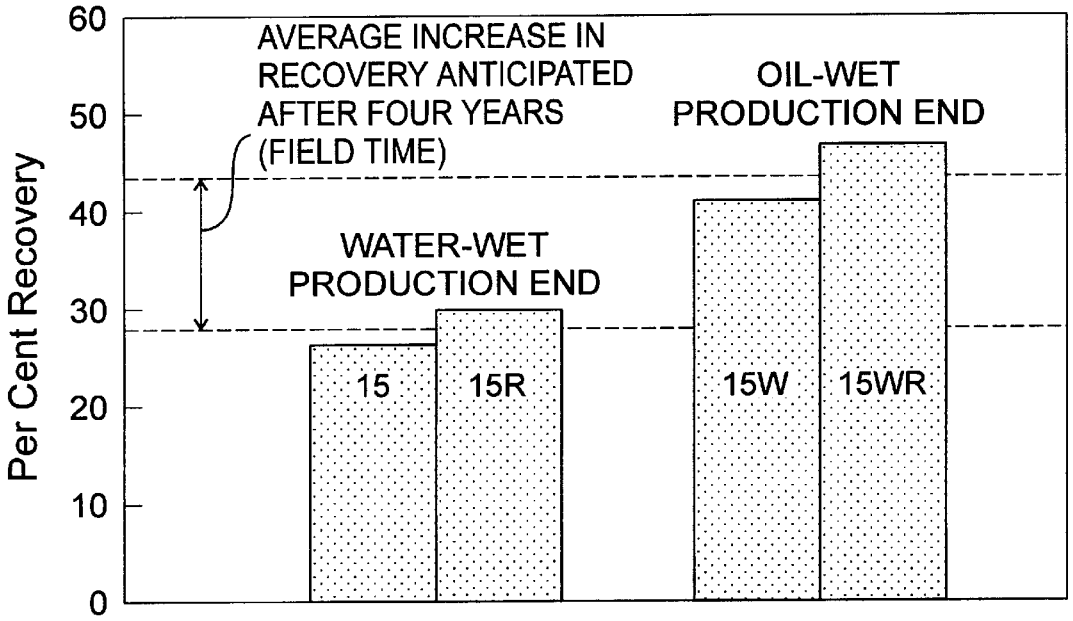
FIG. 8 is a bar graph showing the percent recovery of oil after 200 minutes.

Both runs were done in duplicate and FIG. 7 is a plot of the percent oil recovery versus time in minutes for all four runs. It can be clearly seen from this plot that the addition of oil-wet sand around the production well increased both the rate of oil recovery and the percent of oil recovery. Having reference to FIG. 7, is can be seen that in the runs without the addition of oil-wet sand, it took an average of 425 minutes to achieve 40% oil recovery. However, in the runs where an oil-wet sand layer surrounded the production well, it took less than half the time (175 minutes) to achieve 40% oil recovery. FIG. 8 is a bar graph showing the percent recovery of oil for all runs after 200 minutes. The average recovery of oil for the runs without the oil-wet sand layer was 27.5%. However, the average recovery of oil for the runs with the oil-wet sand layer was 43%. This represents a 64% increase in the percent of oil recovered.

EXAMPLE IV

The improvement in oil production observed during laboratory experiments when an oil-wet region surrounded the production well was further investigated using a numerical simulator to examine if the above phenomenon would prevail on a field scale. A 500 m deep reservoir was assumed in a numerical model, which had a pay-zone thickness of 21 m. Two superimposed horizontal wells, each 500 m long, were placed near the bottom of the pay-zone 4 m apart from one another. A SAGD process was simulated whereby steam was injected into the top well (the "injection well") at a pressure of 3.1 MPa and oil was collected in the bottom well (the "production well"). In one instance, the reservoir surrounding the production well remained water-wet. In another instance, an oil-wet zone was placed around the production well. This was achieved by using capillary pressure and relative permeability functions for water-wet and oil-wet sands.

Figure 9:
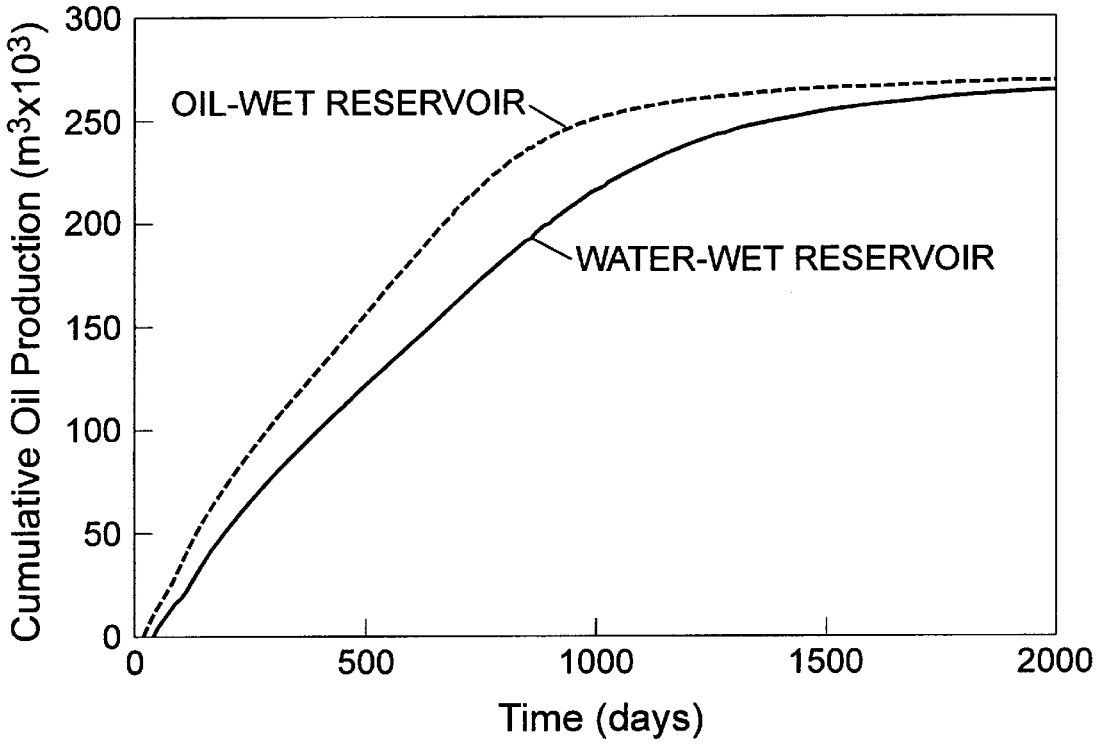
FIG. 9 is a plot of the cumulative oil production versus time in days.

The field scale numerical results are shown in FIG. 9, a plot of the cumulative oil production versus time in days. It was clear that oil production rates increased when an oil-wet region was added to the production zone. Further, the results show that the starting of oil production can be advanced when an oil-wet zone is placed around the production well. The effect of the oil-wet region was most significant during the first two years of operation.

EXAMPLE V

Bottom water drive experiments were done in order to test the effectiveness of various anti-coning agents in preventing penetration of the production well by reservoir water. It was observed that when the porous region around the production well was rendered oil-wet, the coning of the water was significantly reduced. The oil recovery in the oil-wet case was higher by as much as 20% over that of the water-wet case.

Bottom-water drive experiments were done using visualization cells as described in Paper 96-13 of the Petroleum Society of the CIM $47^{th}$ Annual Technical Meeting, Jun. 10–12, 1996. It was observed that when only water-wet sand was used, coning around the production well occurred due to imbibition and early breakthrough of water. By contrast, when oil-wet sand was packed around the production well, water breakthrough to the producer was delayed and therefore coning was also delayed.

The embodiments of the invention in which an exclusive property or privilege is claimed are defined as follows:

1. A thermal recovery method for recovering hydrocarbons from a subterranean formation, comprising:

(a) providing at least one injection well and at least one production well, the production well having a substantially oil-wet near well-bore region, wherein the injection well and production well are vertically spaced-apart in the formation and are disposed in a substantially horizontal and parallel arrangement;

(b) establishing fluid communication between the injection well and the production well;

(c) injecting steam into the formation through the injection well;

(d) recovering the hydrocarbons by gravity drainage to the production well, under a formation pressure gradient between the injection well and the production well of about 10 kPa/m, wherein the substantially oil-wet near well-bore region of the production well enhances the amount of hydrocarbons produced as compared to a substantially similar method of recovery in the formation, under the same pressure gradient, having a substantially water-wet near well-bore region.

2. The method of claim 1 wherein said substantially oil-wet near well-bore region is provided by a pre-injection treatment of solids to produce oil-wet solids and injecting the oil-wet solids into the near well-bore region of the production well.

3. The method of claim 2 wherein the pre-injection treatment includes treating water-wet solids, having a water layer external to the solids and an oil layer external to the water layer, with an acidic solution.

4. The method of claim 2 wherein the pre-injection treatment includes treating the solids with a mixture comprising an asphaltene and a hydrocarbon solvent.

5. The method of claim 1 wherein the substantially oil-wet near well-bore region is provided by an in situ treatment wherein a substantial portion of solids in the production well's near well-bore region is treated while in place in the production well's near well-bore region.

6. The method of claim 5 wherein the in situ treatment includes treating, in the near well-bore region, water-wet solids, having a water layer external to the solids and an oil layer external to the water layer, with an acidic solution.

7. The method of claim 5 wherein the in situ treatment includes treating, in the near well-bore region, the solids with a mixture comprising an asphaltene and a hydrocarbon solvent.

8. The method of claim 1 wherein the fluid communication is established by simultaneously circulating steam through the injection well and the production well to heat at least a portion of the formation by conduction so that the heat of conduction reduces the viscosity of at least a portion of the hydrocarbons between the injection well and the production well and the hydrocarbons with reduced viscosity thereby drain under a pressure gradient produced by gravity into the oil-wet near well-bore region.

9. The method of claim 8 whereby the hydrocarbons are imbibed into the oil-wet near well-bore region.

* * * * *